US011827967B2

(12) United States Patent
Shibata et al.

(10) Patent No.: US 11,827,967 B2
(45) **Date of Patent: *Nov. 28, 2023**

(54) METHOD FOR PRODUCING ALUMINUM ALLOY EXTRUDED MATERIAL

(71) Applicant: AISIN KEIKINZOKU CO.,LTD., Imizu (JP)

(72) Inventors: Karin Shibata, Oyabe (JP); Tomoo Yoshida, Toyama (JP)

(73) Assignee: AISIN KEIKINZOKU CO., LTD.

( * ) Notice: Subject to any disclaimer, the term of this patent is extended or adjusted under 35 U.S.C. 154(b) by 423 days.

This patent is subject to a terminal disclaimer.

(21) Appl. No.: 16/796,973

(22) Filed: Feb. 21, 2020

(65) Prior Publication Data

US 2020/0270729 A1 Aug. 27, 2020

(30) Foreign Application Priority Data

Feb. 22, 2019 (JP) ..... 2019-029930
Jan. 16, 2020 (JP) ..... 2020-005108

(51) Int. Cl.
*C22F 1/053* (2006.01)
*C22C 21/10* (2006.01)
*B21C 1/00* (2006.01)

(52) U.S. Cl.
CPC ..... *C22F 1/053* (2013.01); *B21C 1/003* (2013.01); *C22C 21/10* (2013.01)

(58) Field of Classification Search
None
See application file for complete search history.

(56) References Cited

U.S. PATENT DOCUMENTS 8,876,993 B2 † 11/2014 Miyata
10,138,537 B2 11/2018 Hashimoto et al.
(Continued)

FOREIGN PATENT DOCUMENTS

JP 2928445 B2 8/1999
JP 2014-145119 A 8/2014
(Continued)

OTHER PUBLICATIONS

Tkachenko, "The Properties and Structure of High Strength Aluminum 1933 Alloy Forging," Aluminum Alloys: Thier Physical and Mechanical Properties—Proceedings ICAA5—Part 3, pp. 1819-1822, Transtec Publication, 1996.†
(Continued)

*Primary Examiner* — Sally A Merkling
*Assistant Examiner* — Sean P. O'Keefe
(74) *Attorney, Agent, or Firm* — Harness, Dickey & Pierce, P.L.C.

(57) ABSTRACT

A method for producing an aluminum alloy extruded material includes: subjecting, to extrusion processing, a casted billet obtained from an aluminum alloy containing 6.0 to 8.0% by mass of Zn, 1.50 to 3.50% by mass of Mg, 0.20 to 1.50% by mass of Cu, 0.10 to 0.25% by mass of Zr, 0.005 to 0.05% by mass of Ti, 0.3% by mass or less of Mn, 0.25% by mass or less of Sr, contents of Mn, Zr and Sr being 0.10 to 0.50% by mass, with the balance being Al and inevitable impurities to obtain an extruded material; cooling the extruded material, immediately after the extrusion processing, to 100° C. or less at a cooling rate of 50 to 750° C./min; then subjecting the extruded material to a heat treatment at 110 to 270° C. and subjecting the extruded material to plastic working within a prescribed time after the heat treatment.

4 Claims, 6 Drawing Sheets

| | | Alloy Component (mass%) | | | | | | | | | | Mn+Zr+Sr |
|---|---|---|---|---|---|---|---|---|---|---|---|---|
| | | Si | Fe | Cu | Mn | Mg | Cr | Zn | Zr | Sr | Ti | |
| 1 | Example | 0.05 | 0.15 | 0.25 | 0.25 | 2.42 | 0.00 | 6.70 | 0.19 | 0.00 | 0.03 | 0.43 |
| 2 | | 0.05 | 0.15 | 0.25 | 0.25 | 2.42 | 0.00 | 6.70 | 0.19 | 0.00 | 0.03 | 0.43 |
| 3 | | 0.05 | 0.15 | 0.25 | 0.25 | 2.42 | 0.00 | 6.70 | 0.19 | 0.00 | 0.03 | 0.43 |
| 4 | | 0.05 | 0.15 | 0.25 | 0.25 | 2.42 | 0.00 | 6.70 | 0.19 | 0.00 | 0.03 | 0.43 |
| 5 | | 0.05 | 0.15 | 0.25 | 0.25 | 2.42 | 0.00 | 6.70 | 0.19 | 0.00 | 0.03 | 0.43 |
| 6 | | 0.05 | 0.15 | 0.25 | 0.24 | 2.53 | 0.00 | 6.72 | 0.19 | 0.00 | 0.03 | 0.43 |
| 7 | | 0.05 | 0.15 | 0.25 | 0.24 | 2.53 | 0.00 | 6.72 | 0.19 | 0.00 | 0.03 | 0.43 |
| 8 | | 0.05 | 0.15 | 0.25 | 0.24 | 2.53 | 0.00 | 6.72 | 0.19 | 0.00 | 0.03 | 0.43 |
| 9 | | 0.05 | 0.15 | 0.25 | 0.24 | 2.53 | 0.00 | 6.72 | 0.19 | 0.00 | 0.03 | 0.43 |
| 10 | | 0.05 | 0.15 | 0.25 | 0.24 | 2.53 | 0.00 | 6.72 | 0.19 | 0.00 | 0.03 | 0.43 |
| 11 | | 0.05 | 0.15 | 0.25 | 0.25 | 2.80 | 0.00 | 6.75 | 0.20 | 0.00 | 0.03 | 0.45 |
| 12 | | 0.05 | 0.15 | 0.25 | 0.25 | 2.80 | 0.00 | 6.75 | 0.20 | 0.00 | 0.03 | 0.45 |
| 13 | | 0.05 | 0.15 | 0.25 | 0.25 | 2.80 | 0.00 | 6.75 | 0.20 | 0.00 | 0.03 | 0.45 |
| 14 | | 0.05 | 0.15 | 0.25 | 0.25 | 2.80 | 0.00 | 6.75 | 0.20 | 0.00 | 0.03 | 0.45 |
| 15 | | 0.05 | 0.15 | 0.25 | 0.25 | 2.80 | 0.00 | 6.75 | 0.20 | 0.00 | 0.03 | 0.45 |
| 16 | | 0.05 | 0.15 | 0.25 | 0.25 | 2.80 | 0.00 | 6.75 | 0.20 | 0.02 | 0.03 | 0.47 |
| 17 | | 0.04 | 0.15 | 0.25 | 0.20 | 3.30 | 0.00 | 6.65 | 0.20 | 0.00 | 0.03 | 0.40 |
| 18 | | 0.04 | 0.15 | 0.25 | 0.20 | 3.30 | 0.00 | 6.65 | 0.20 | 0.00 | 0.03 | 0.40 |
| 19 | | 0.04 | 0.15 | 0.25 | 0.20 | 3.30 | 0.00 | 6.65 | 0.20 | 0.00 | 0.03 | 0.40 |
| 20 | | 0.04 | 0.15 | 0.25 | 0.20 | 3.30 | 0.00 | 6.65 | 0.20 | 0.00 | 0.03 | 0.40 |
| 21 | | 0.04 | 0.15 | 0.25 | 0.20 | 3.30 | 0.00 | 6.65 | 0.20 | 0.00 | 0.03 | 0.40 |
| 22 | | 0.04 | 0.15 | 0.25 | 0.20 | 3.30 | 0.00 | 6.65 | 0.20 | 0.00 | 0.03 | 0.40 |
| 23 | | 0.04 | 0.15 | 0.25 | 0.20 | 3.30 | 0.00 | 6.65 | 0.20 | 0.00 | 0.03 | 0.40 |
| 24 | | 0.04 | 0.15 | 0.25 | 0.20 | 3.30 | 0.00 | 6.65 | 0.20 | 0.00 | 0.03 | 0.40 |
| 25 | | 0.04 | 0.15 | 0.25 | 0.20 | 3.30 | 0.00 | 6.65 | 0.20 | 0.01 | 0.03 | 0.41 |
| 26 | | 0.04 | 0.15 | 0.25 | 0.20 | 3.30 | 0.00 | 6.65 | 0.20 | 0.01 | 0.03 | 0.41 |
| 27 | | 0.04 | 0.15 | 0.25 | 0.20 | 3.30 | 0.00 | 6.65 | 0.20 | 0.01 | 0.03 | 0.41 |
| 28 | | 0.04 | 0.15 | 0.25 | 0.20 | 3.30 | 0.00 | 6.65 | 0.20 | 0.00 | 0.03 | 0.40 |
| 29 | | 0.04 | 0.15 | 0.25 | 0.20 | 3.30 | 0.00 | 6.65 | 0.20 | 0.00 | 0.03 | 0.40 |
| 30 | | 0.04 | 0.15 | 0.25 | 0.20 | 3.30 | 0.00 | 6.65 | 0.20 | 0.00 | 0.03 | 0.40 |
| 31 | | 0.04 | 0.15 | 0.25 | 0.20 | 3.30 | 0.00 | 6.65 | 0.20 | 0.00 | 0.03 | 0.40 |
| 32 | | 0.04 | 0.15 | 0.25 | 0.20 | 3.30 | 0.00 | 6.65 | 0.20 | 0.00 | 0.03 | 0.40 |
| 33 | | 0.05 | 0.13 | 0.24 | 0.23 | 1.73 | 0.01 | 6.77 | 0.20 | 0.00 | 0.02 | 0.43 |
| 34 | | 0.05 | 0.13 | 0.24 | 0.23 | 1.73 | 0.01 | 6.77 | 0.20 | 0.00 | 0.02 | 0.43 |
| 35 | | 0.05 | 0.13 | 0.24 | 0.23 | 1.73 | 0.01 | 6.77 | 0.20 | 0.00 | 0.02 | 0.43 |
| 36 | | 0.05 | 0.13 | 0.24 | 0.23 | 1.73 | 0.01 | 6.77 | 0.20 | 0.00 | 0.02 | 0.43 |
| 37 | | 0.05 | 0.13 | 0.24 | 0.23 | 1.73 | 0.01 | 6.77 | 0.20 | 0.00 | 0.02 | 0.43 |
| 38 | | 0.05 | 0.13 | 0.24 | 0.23 | 1.73 | 0.01 | 6.77 | 0.20 | 0.00 | 0.02 | 0.43 |
| 39 | | 0.05 | 0.13 | 0.24 | 0.23 | 1.73 | 0.01 | 6.77 | 0.20 | 0.00 | 0.02 | 0.43 |
| 40 | | 0.05 | 0.13 | 0.24 | 0.23 | 1.73 | 0.01 | 6.77 | 0.20 | 0.00 | 0.02 | 0.43 |
| 41 | | 0.05 | 0.13 | 0.24 | 0.23 | 1.73 | 0.01 | 6.77 | 0.20 | 0.00 | 0.02 | 0.43 |
| 42 | | 0.05 | 0.13 | 0.24 | 0.23 | 1.73 | 0.01 | 6.77 | 0.20 | 0.00 | 0.02 | 0.43 |
| 43 | | 0.05 | 0.13 | 0.24 | 0.23 | 1.73 | 0.01 | 6.77 | 0.20 | 0.00 | 0.02 | 0.43 |
| 44 | | 0.05 | 0.13 | 0.24 | 0.23 | 1.73 | 0.01 | 6.77 | 0.20 | 0.00 | 0.02 | 0.43 |
| 45 | | 0.05 | 0.13 | 0.24 | 0.23 | 1.73 | 0.01 | 6.77 | 0.20 | 0.00 | 0.02 | 0.43 |
| 46 | | 0.05 | 0.13 | 0.24 | 0.23 | 1.73 | 0.01 | 6.77 | 0.20 | 0.00 | 0.02 | 0.43 |
| 47 | | 0.05 | 0.13 | 0.24 | 0.23 | 1.73 | 0.01 | 6.77 | 0.20 | 0.00 | 0.02 | 0.43 |
| 48 | | 0.05 | 0.13 | 0.24 | 0.23 | 1.73 | 0.01 | 6.77 | 0.20 | 0.00 | 0.02 | 0.43 |

(56) References Cited

U.S. PATENT DOCUMENTS

| | | | | |
|---|---|---|---|---|
| 10,900,108 | B2 * | 1/2021 | Yoshida | C22F 1/053 |
| 2004/0089382 | A1 | 5/2004 | Senkov et al. | |
| 2007/0074791 | A1 * | 4/2007 | Yoshida | C22C 21/10 148/439 |
| 2008/0299000 | A1 | 12/2008 | Gheorghe et al. | |
| 2012/0055588 | A1 | 3/2012 | Kamat et al. | |
| 2012/0234440 | A1 | 9/2012 | Miyata et al. | |
| 2014/0209223 | A1 | 7/2014 | Hashimoto et al. | |
| 2018/0087139 | A1 | 3/2018 | Hashimoto et al. | |
| 2019/0024224 | A1 * | 1/2019 | Shibata | C22C 21/10 |
| 2020/0270729 | A1 | 8/2020 | Shibata et al. | |

FOREIGN PATENT DOCUMENTS

| | | | | |
|---|---|---|---|---|
| KR | 2017132116 | A * | 12/2017 | C22C 21/10 |
| WO | WO-2017169962 | A1 * | 10/2017 | B21C 23/00 |

OTHER PUBLICATIONS

Mondolfo, "Aluminum Alloys: Structures & Properties," pp. 844-864, Buttersworths London—Boston, 1976.†

Williamson, "Elevated Temperature Exposure Effects: A comparison of 6xxx-series and 7xxx-series Alloys," Extrusion Technology Conference Proceedings 2016, pp. 113-123, Aluminum Extruders Council, May 2016.†

Shahani, "High Strength 7xxx Alloys for Ultra-Thick Aerospace Plate: Optimisation of Alloy Composition", Aluminum Alloys Their Physical and Mechanical Properties vol. 2 Proceedings of the 6th International Conference on Aluminum Alloys; The Japan Institute of Light Metals, pp. 1105-1110, Jul. 1998.†

Aluminum Association, "International Alloy Designations and Chemical Composition Limits for Wrought Aluminum and Wrought Aluminum Alloys," Aluminum Association, Arlington, VA, pp. 1-14, Jan. 2015.†

* cited by examiner
† cited by third party

FIG. 1

| | | Alloy Component (mass%) | | | | | | | | | | Mn+Zr +Sr |
|---|---|---|---|---|---|---|---|---|---|---|---|---|
| | | Si | Fe | Cu | Mn | Mg | Cr | Zn | Zr | Sr | Ti | |
| 1 | Example | 0.05 | 0.15 | 0.25 | 0.25 | 2.42 | 0.00 | 6.70 | 0.18 | 0.00 | 0.03 | 0.43 |
| 2 | | 0.05 | 0.15 | 0.25 | 0.25 | 2.42 | 0.00 | 6.70 | 0.18 | 0.00 | 0.03 | 0.43 |
| 3 | | 0.05 | 0.15 | 0.25 | 0.25 | 2.42 | 0.00 | 6.70 | 0.18 | 0.00 | 0.03 | 0.43 |
| 4 | | 0.05 | 0.15 | 0.25 | 0.25 | 2.42 | 0.00 | 6.70 | 0.18 | 0.00 | 0.03 | 0.43 |
| 5 | | 0.05 | 0.15 | 0.25 | 0.25 | 2.42 | 0.00 | 6.70 | 0.18 | 0.00 | 0.03 | 0.43 |
| 6 | | 0.06 | 0.16 | 0.25 | 0.24 | 2.63 | 0.00 | 6.72 | 0.19 | 0.00 | 0.03 | 0.43 |
| 7 | | 0.06 | 0.16 | 0.25 | 0.24 | 2.63 | 0.00 | 6.72 | 0.19 | 0.00 | 0.03 | 0.43 |
| 8 | | 0.06 | 0.16 | 0.25 | 0.24 | 2.63 | 0.00 | 6.72 | 0.19 | 0.00 | 0.03 | 0.43 |
| 9 | | 0.06 | 0.16 | 0.25 | 0.24 | 2.63 | 0.00 | 6.72 | 0.19 | 0.00 | 0.03 | 0.43 |
| 10 | | 0.06 | 0.16 | 0.25 | 0.24 | 2.63 | 0.00 | 6.72 | 0.19 | 0.00 | 0.03 | 0.43 |
| 11 | | 0.06 | 0.16 | 0.25 | 0.25 | 2.80 | 0.00 | 6.75 | 0.20 | 0.00 | 0.03 | 0.45 |
| 12 | | 0.06 | 0.16 | 0.25 | 0.25 | 2.80 | 0.00 | 6.75 | 0.20 | 0.00 | 0.03 | 0.45 |
| 13 | | 0.06 | 0.16 | 0.25 | 0.25 | 2.80 | 0.00 | 6.75 | 0.20 | 0.00 | 0.03 | 0.45 |
| 14 | | 0.06 | 0.16 | 0.25 | 0.25 | 2.80 | 0.00 | 6.75 | 0.20 | 0.00 | 0.03 | 0.45 |
| 15 | | 0.06 | 0.16 | 0.25 | 0.25 | 2.80 | 0.00 | 6.75 | 0.20 | 0.00 | 0.03 | 0.45 |
| 16 | | 0.06 | 0.16 | 0.25 | 0.25 | 2.80 | 0.00 | 6.75 | 0.20 | 0.02 | 0.03 | 0.47 |
| 17 | | 0.04 | 0.15 | 0.25 | 0.20 | 3.30 | 0.00 | 6.65 | 0.20 | 0.00 | 0.03 | 0.40 |
| 18 | | 0.04 | 0.15 | 0.25 | 0.20 | 3.30 | 0.00 | 6.65 | 0.20 | 0.00 | 0.03 | 0.40 |
| 19 | | 0.04 | 0.15 | 0.25 | 0.20 | 3.30 | 0.00 | 6.65 | 0.20 | 0.00 | 0.03 | 0.40 |
| 20 | | 0.04 | 0.15 | 0.25 | 0.20 | 3.30 | 0.00 | 6.65 | 0.20 | 0.00 | 0.03 | 0.40 |
| 21 | | 0.04 | 0.15 | 0.25 | 0.20 | 3.30 | 0.00 | 6.65 | 0.20 | 0.00 | 0.03 | 0.40 |
| 22 | | 0.04 | 0.15 | 0.25 | 0.20 | 3.30 | 0.00 | 6.65 | 0.20 | 0.00 | 0.03 | 0.40 |
| 23 | | 0.04 | 0.15 | 0.25 | 0.20 | 3.30 | 0.00 | 6.65 | 0.20 | 0.00 | 0.03 | 0.40 |
| 24 | | 0.04 | 0.15 | 0.25 | 0.20 | 3.30 | 0.00 | 6.65 | 0.20 | 0.00 | 0.03 | 0.40 |
| 25 | | 0.04 | 0.15 | 0.25 | 0.20 | 3.30 | 0.00 | 6.65 | 0.20 | 0.01 | 0.03 | 0.41 |
| 26 | | 0.04 | 0.15 | 0.25 | 0.20 | 3.30 | 0.00 | 6.65 | 0.20 | 0.01 | 0.03 | 0.41 |
| 27 | | 0.04 | 0.15 | 0.25 | 0.20 | 3.30 | 0.00 | 6.65 | 0.20 | 0.01 | 0.03 | 0.41 |
| 28 | | 0.04 | 0.15 | 0.25 | 0.20 | 3.30 | 0.00 | 6.65 | 0.20 | 0.00 | 0.03 | 0.40 |
| 29 | | 0.04 | 0.15 | 0.25 | 0.20 | 3.30 | 0.00 | 6.65 | 0.20 | 0.00 | 0.03 | 0.40 |
| 30 | | 0.04 | 0.15 | 0.25 | 0.20 | 3.30 | 0.00 | 6.65 | 0.20 | 0.00 | 0.03 | 0.40 |
| 31 | | 0.04 | 0.15 | 0.25 | 0.20 | 3.30 | 0.00 | 6.65 | 0.20 | 0.00 | 0.03 | 0.40 |
| 32 | | 0.04 | 0.15 | 0.25 | 0.20 | 3.30 | 0.00 | 6.65 | 0.20 | 0.00 | 0.03 | 0.40 |
| 33 | | 0.05 | 0.13 | 0.24 | 0.23 | 1.73 | 0.01 | 6.77 | 0.20 | 0.00 | 0.02 | 0.43 |
| 34 | | 0.05 | 0.13 | 0.24 | 0.23 | 1.73 | 0.01 | 6.77 | 0.20 | 0.00 | 0.02 | 0.43 |
| 35 | | 0.05 | 0.13 | 0.24 | 0.23 | 1.73 | 0.01 | 6.77 | 0.20 | 0.00 | 0.02 | 0.43 |
| 36 | | 0.05 | 0.13 | 0.24 | 0.23 | 1.73 | 0.01 | 6.77 | 0.20 | 0.00 | 0.02 | 0.43 |
| 37 | | 0.05 | 0.13 | 0.24 | 0.23 | 1.73 | 0.01 | 6.77 | 0.20 | 0.00 | 0.02 | 0.43 |
| 38 | | 0.05 | 0.13 | 0.24 | 0.23 | 1.73 | 0.01 | 6.77 | 0.20 | 0.00 | 0.02 | 0.43 |
| 39 | | 0.05 | 0.13 | 0.24 | 0.23 | 1.73 | 0.01 | 6.77 | 0.20 | 0.00 | 0.02 | 0.43 |
| 40 | | 0.05 | 0.13 | 0.24 | 0.23 | 1.73 | 0.01 | 6.77 | 0.20 | 0.00 | 0.02 | 0.43 |
| 41 | | 0.05 | 0.13 | 0.24 | 0.23 | 1.73 | 0.01 | 6.77 | 0.20 | 0.00 | 0.02 | 0.43 |
| 42 | | 0.05 | 0.13 | 0.24 | 0.23 | 1.73 | 0.01 | 6.77 | 0.20 | 0.00 | 0.02 | 0.43 |
| 43 | | 0.05 | 0.13 | 0.24 | 0.23 | 1.73 | 0.01 | 6.77 | 0.20 | 0.00 | 0.02 | 0.43 |
| 44 | | 0.05 | 0.13 | 0.24 | 0.23 | 1.73 | 0.01 | 6.77 | 0.20 | 0.00 | 0.02 | 0.43 |
| 45 | | 0.05 | 0.13 | 0.24 | 0.23 | 1.73 | 0.01 | 6.77 | 0.20 | 0.00 | 0.02 | 0.43 |
| 46 | | 0.05 | 0.13 | 0.24 | 0.23 | 1.73 | 0.01 | 6.77 | 0.20 | 0.00 | 0.02 | 0.43 |
| 47 | | 0.05 | 0.13 | 0.24 | 0.23 | 1.73 | 0.01 | 6.77 | 0.20 | 0.00 | 0.02 | 0.43 |
| 48 | | 0.05 | 0.13 | 0.24 | 0.23 | 1.73 | 0.01 | 6.77 | 0.20 | 0.00 | 0.02 | 0.43 |

FIG. 2

| | | Alloy Component (mass%) | | | | | | | | | | Mn+Zr +Sr |
|---|---|---|---|---|---|---|---|---|---|---|---|---|
| | | Si | Fe | Cu | Mn | Mg | Cr | Zn | Zr | Sr | Ti | |
| 101 | Comparative Example | 0.04 | 0.15 | 0.25 | 0.20 | 3.30 | 0.00 | 6.65 | 0.20 | 0.00 | 0.03 | 0.40 |
| 102 | | 0.04 | 0.15 | 0.25 | 0.20 | 3.30 | 0.00 | 6.65 | 0.20 | 0.00 | 0.03 | 0.40 |
| 103 | | 0.04 | 0.15 | 0.25 | 0.20 | 3.30 | 0.00 | 6.65 | 0.20 | 0.00 | 0.03 | 0.40 |
| 104 | | 0.04 | 0.15 | 0.25 | 0.20 | 3.30 | 0.00 | 6.65 | 0.20 | 0.00 | 0.03 | 0.40 |
| 105 | | 0.04 | 0.15 | 0.25 | 0.20 | 3.30 | 0.00 | 6.65 | 0.20 | 0.00 | 0.03 | 0.40 |
| 106 | | 0.04 | 0.15 | 0.25 | 0.20 | 3.30 | 0.00 | 6.65 | 0.20 | 0.00 | 0.03 | 0.40 |
| 107 | | 0.04 | 0.15 | 0.25 | 0.20 | 3.30 | 0.00 | 6.65 | 0.20 | 0.00 | 0.03 | 0.40 |
| 108 | | 0.05 | 0.13 | 0.24 | 0.23 | 1.73 | 0.01 | 6.77 | 0.20 | 0.00 | 0.02 | 0.43 |
| 109 | | 0.05 | 0.13 | 0.24 | 0.23 | 1.73 | 0.01 | 6.77 | 0.20 | 0.00 | 0.02 | 0.43 |
| 110 | | 0.05 | 0.13 | 0.24 | 0.23 | 1.73 | 0.01 | 6.77 | 0.20 | 0.00 | 0.02 | 0.43 |
| 111 | | 0.05 | 0.13 | 0.24 | 0.23 | 1.73 | 0.01 | 6.77 | 0.20 | 0.00 | 0.02 | 0.43 |
| 112 | | 0.05 | 0.13 | 0.24 | 0.23 | 1.73 | 0.01 | 6.77 | 0.20 | 0.00 | 0.02 | 0.43 |
| 113 | | 0.05 | 0.13 | 0.24 | 0.23 | 1.73 | 0.01 | 6.77 | 0.20 | 0.00 | 0.02 | 0.43 |
| 114 | | 0.05 | 0.13 | 0.24 | 0.23 | 1.73 | 0.01 | 6.77 | 0.20 | 0.00 | 0.02 | 0.43 |
| 115 | | 0.04 | 0.15 | 0.25 | 0.20 | 3.30 | 0.00 | 6.65 | 0.20 | 0.00 | 0.03 | 0.40 |
| 116 | | 0.05 | 0.13 | 0.24 | 0.23 | 1.73 | 0.01 | 6.77 | 0.20 | 0.00 | 0.02 | 0.43 |
| 117 | | 0.04 | 0.15 | 0.25 | 0.20 | 3.30 | 0.00 | 6.65 | 0.20 | 0.00 | 0.03 | 0.40 |
| 118 | | 0.04 | 0.15 | 0.25 | 0.20 | 3.30 | 0.00 | 6.65 | 0.20 | 0.00 | 0.03 | 0.40 |
| 119 | | 0.05 | 0.13 | 0.24 | 0.23 | 1.73 | 0.01 | 6.77 | 0.20 | 0.00 | 0.02 | 0.43 |
| 120 | | 0.05 | 0.13 | 0.24 | 0.23 | 1.73 | 0.01 | 6.77 | 0.20 | 0.00 | 0.02 | 0.43 |
| 121 | | 0.05 | 0.15 | 1.60 | 0.26 | 2.50 | 0.26 | 5.60 | 0.00 | 0.00 | 0.03 | 0.26 |
| 122 | | 0.05 | 0.13 | 0.25 | 0.00 | 1.21 | 0.01 | 6.70 | 0.20 | 0.00 | 0.03 | 0.20 |

FIG. 3

| | | Casting Rate (mm/min) | HOMO | | Pillet Crystal Grain Size (μm) | BLT Temperature (°C) | Cooling Rate (°C/min) | Temperature Increasing Rate (°C/sec) | Heating Temperature (°C) | Heating Time (sec) | Bonding Start Time (Natural Aging Time) | Heat Treatment Condition (°C) | | Heat Treatment Condition (hr) | | |
|---|---|---|---|---|---|---|---|---|---|---|---|---|---|---|---|---|
| | | | Temperature (°C) | Time (hr) | | | | | | | | First Stage | Second Stage | First Stage | Second Stage | Total Time |
| 1 | Example | 70 | 500 | 6 | 180 | 440 | 250 | 2.3 | 160 | 80 | 48 | 110 | 140 | 6 | 6 | 12 |
| 2 | | 70 | 500 | 6 | 180 | 440 | 250 | 2.6 | 180 | 80 | 48 | 120 | 150 | 4 | 6 | 10 |
| 3 | | 70 | 500 | 6 | 180 | 440 | 250 | 2.9 | 200 | 80 | 48 | 120 | 150 | 4 | 6 | 10 |
| 4 | | 70 | 500 | 6 | 180 | 440 | 250 | 3.1 | 220 | 80 | 48 | 120 | 150 | 4 | 6 | 10 |
| 5 | | 70 | 500 | 6 | 180 | 440 | 250 | 3.4 | 240 | 80 | 48 | 110 | 150 | 6 | 6 | 10 |
| 6 | | 70 | 510 | 4 | 190 | 430 | 280 | 2.3 | 160 | 80 | 48 | 110 | 140 | 6 | 6 | 12 |
| 7 | | 70 | 510 | 4 | 190 | 430 | 280 | 2.6 | 180 | 80 | 48 | 120 | 150 | 4 | 6 | 10 |
| 8 | | 70 | 510 | 4 | 190 | 430 | 280 | 2.9 | 200 | 80 | 48 | 120 | 150 | 4 | 6 | 10 |
| 9 | | 70 | 510 | 4 | 190 | 430 | 280 | 3.1 | 220 | 80 | 48 | 120 | 150 | 4 | 6 | 10 |
| 10 | | 70 | 510 | 4 | 190 | 430 | 280 | 3.4 | 240 | 80 | 48 | 110 | 150 | 6 | 6 | 10 |
| 11 | | 70 | 500 | 4 | 200 | 430 | 500 | 2.3 | 160 | 80 | 48 | 110 | 140 | 6 | 6 | 12 |
| 12 | | 70 | 500 | 4 | 200 | 430 | 500 | 2.6 | 180 | 80 | 48 | 110 | 140 | 6 | 6 | 12 |
| 13 | | 70 | 500 | 4 | 200 | 430 | 500 | 2.6 | 180 | 80 | 48 | 110 | 140 | 6 | 6 | 12 |
| 14 | | 70 | 500 | 4 | 200 | 430 | 500 | 2.6 | 180 | 80 | 48 | 110 | 140 | 6 | 6 | 12 |
| 15 | | 70 | 500 | 4 | 200 | 430 | 500 | 2.6 | 180 | 80 | 48 | 110 | 140 | 6 | 6 | 12 |
| 16 | | 70 | 500 | 4 | 200 | 430 | 500 | 2.6 | 180 | 80 | 48 | 110 | 140 | 6 | 6 | 12 |
| 17 | | 70 | 500 | 4 | 170 | 430 | 300 | 1.7 | 120 | 80 | 48 | 110 | 140 | 6 | 6 | 12 |
| 18 | | 70 | 500 | 4 | 170 | 430 | 300 | 2.0 | 140 | 80 | 48 | 110 | 140 | 6 | 6 | 12 |
| 19 | | 70 | 500 | 4 | 170 | 430 | 300 | 2.3 | 160 | 80 | 48 | 110 | 140 | 6 | 6 | 12 |
| 20 | | 70 | 500 | 4 | 170 | 430 | 300 | 2.6 | 180 | 80 | 48 | 110 | 140 | 6 | 6 | 12 |
| 21 | | 70 | 500 | 4 | 170 | 430 | 300 | 2.9 | 200 | 80 | 48 | 110 | 140 | 6 | 6 | 12 |
| 22 | | 70 | 500 | 4 | 170 | 430 | 300 | 3.1 | 220 | 80 | 48 | 110 | 140 | 6 | 6 | 12 |
| 23 | | 70 | 500 | 4 | 170 | 430 | 300 | 3.4 | 240 | 80 | 48 | 110 | 140 | 6 | 6 | 12 |
| 24 | | 70 | 500 | 4 | 170 | 430 | 300 | 3.7 | 260 | 80 | 48 | 110 | 140 | 6 | 6 | 12 |
| 25 | | 70 | 500 | 4 | 170 | 430 | 300 | 1.7 | 120 | 600 | 48 | 110 | 140 | 6 | 6 | 12 |
| 26 | | 70 | 500 | 4 | 170 | 430 | 300 | 2.0 | 140 | 600 | 48 | 110 | 140 | 6 | 6 | 12 |
| 27 | | 70 | 500 | 4 | 170 | 430 | 300 | 2.3 | 160 | 600 | 48 | 110 | 140 | 6 | 6 | 12 |
| 28 | | 70 | 500 | 4 | 170 | 430 | 300 | 2.6 | 180 | 600 | 48 | 110 | 140 | 6 | 6 | 12 |
| 29 | | 70 | 500 | 4 | 170 | 430 | 300 | 2.9 | 200 | 600 | 48 | 110 | 140 | 6 | 6 | 12 |
| 30 | | 70 | 500 | 4 | 170 | 430 | 300 | 3.1 | 220 | 600 | 48 | 110 | 140 | 6 | 6 | 12 |
| 31 | | 70 | 500 | 4 | 170 | 430 | 300 | 3.4 | 240 | 600 | 48 | 110 | 140 | 6 | 6 | 12 |
| 32 | | 70 | 500 | 4 | 170 | 430 | 300 | 3.7 | 260 | 600 | 48 | 110 | 140 | 6 | 6 | 12 |
| 33 | | 80 | 500 | 4 | 200 | 440 | 140 | 1.7 | 120 | 80 | 48 | 110 | 140 | 4 | 14 | 18 |
| 34 | | 80 | 500 | 4 | 200 | 440 | 140 | 2.0 | 140 | 80 | 48 | 110 | 140 | 4 | 14 | 18 |
| 35 | | 80 | 500 | 4 | 200 | 440 | 140 | 2.3 | 160 | 80 | 48 | 110 | 140 | 4 | 14 | 18 |
| 36 | | 80 | 500 | 4 | 200 | 440 | 140 | 2.6 | 180 | 80 | 48 | 110 | 140 | 4 | 14 | 18 |
| 37 | | 80 | 500 | 4 | 200 | 440 | 140 | 2.9 | 200 | 80 | 48 | 110 | 140 | 4 | 14 | 18 |
| 38 | | 80 | 500 | 4 | 200 | 440 | 140 | 3.1 | 220 | 80 | 48 | 110 | 140 | 4 | 14 | 18 |
| 39 | | 80 | 500 | 4 | 200 | 440 | 140 | 3.4 | 240 | 80 | 48 | 110 | 140 | 4 | 14 | 18 |
| 40 | | 80 | 500 | 4 | 200 | 440 | 140 | 3.7 | 260 | 80 | 48 | 110 | 140 | 4 | 14 | 18 |
| 41 | | 80 | 500 | 4 | 200 | 440 | 140 | 1.7 | 120 | 600 | 48 | 110 | 140 | 4 | 14 | 18 |
| 42 | | 80 | 500 | 4 | 200 | 440 | 140 | 2.0 | 140 | 600 | 48 | 110 | 140 | 4 | 14 | 18 |
| 43 | | 80 | 500 | 4 | 200 | 440 | 140 | 2.3 | 160 | 600 | 48 | 110 | 140 | 4 | 14 | 18 |
| 44 | | 80 | 500 | 4 | 200 | 440 | 140 | 2.6 | 180 | 600 | 48 | 110 | 140 | 4 | 14 | 18 |
| 45 | | 80 | 500 | 4 | 200 | 440 | 140 | 2.9 | 200 | 600 | 48 | 110 | 140 | 4 | 14 | 18 |
| 46 | | 80 | 500 | 4 | 200 | 440 | 140 | 3.1 | 220 | 600 | 48 | 110 | 140 | 4 | 14 | 18 |
| 47 | | 80 | 500 | 4 | 200 | 440 | 140 | 3.4 | 240 | 600 | 48 | 110 | 140 | 4 | 14 | 18 |
| 48 | | 80 | 500 | 4 | 200 | 440 | 140 | 3.7 | 260 | 600 | 48 | 110 | 140 | 4 | 14 | 18 |

FIG. 4

| | | Casting Rate (mm/min) | HOMO | | Billet Crystal Grain Size (μm) | BLT Temperature (℃) | Cooling Rate (℃/min) | Temperature Increasing Rate (℃/sec) | Heating Temperature (℃) | Heating Time (sec) | Bending Start Time (Natural Aging Time) | Heat Treatment Condition (℃) | | Heat Treatment Condition (hr) | | |
|---|---|---|---|---|---|---|---|---|---|---|---|---|---|---|---|---|
| | | | Temperature (℃) | Time (hr) | | | | | | | | First Stage | Second Stage | First Stage | Second Stage | Total Time |
| 101 | Comparative Example | 70 | 500 | 4 | 170 | 430 | 300 | 4.3 | 300 | 80 | 48 | 110 | 140 | 6 | 6 | 12 |
| 102 | | 70 | 500 | 4 | 170 | 430 | 300 | 4.6 | 320 | 80 | 48 | 110 | 140 | 6 | 6 | 12 |
| 103 | | 70 | 500 | 4 | 170 | 430 | 300 | 4.0 | 280 | 600 | 48 | 110 | 140 | 6 | 6 | 12 |
| 104 | | 70 | 500 | 4 | 170 | 430 | 300 | 4.3 | 300 | 600 | 48 | 110 | 140 | 6 | 6 | 12 |
| 105 | | 70 | 500 | 4 | 170 | 430 | 300 | 4.6 | 320 | 600 | 48 | 110 | 140 | 6 | 6 | 12 |
| 106 | | 70 | 500 | 4 | 170 | 430 | 300 | 2.3 | 160 | 1800 | 48 | 110 | 140 | 6 | 6 | 12 |
| 107 | | 70 | 500 | 4 | 170 | 430 | 300 | 2.9 | 200 | 1800 | 48 | 110 | 140 | 6 | 6 | 12 |
| 108 | | 80 | 500 | 4 | 200 | 440 | 140 | 4.0 | 280 | 80 | 48 | 110 | 140 | 4 | 14 | 18 |
| 109 | | 80 | 500 | 4 | 200 | 440 | 140 | 4.3 | 300 | 80 | 48 | 110 | 140 | 4 | 14 | 18 |
| 110 | | 80 | 500 | 4 | 200 | 440 | 140 | 4.6 | 320 | 80 | 48 | 110 | 140 | 4 | 14 | 18 |
| 111 | | 80 | 500 | 4 | 200 | 440 | 140 | 4.0 | 280 | 600 | 48 | 110 | 140 | 4 | 14 | 18 |
| 112 | | 80 | 500 | 4 | 200 | 440 | 140 | 4.3 | 300 | 600 | 48 | 110 | 140 | 4 | 14 | 18 |
| 113 | | 80 | 500 | 4 | 200 | 440 | 140 | 2.3 | 160 | 1800 | 48 | 110 | 140 | 4 | 14 | 18 |
| 114 | | 80 | 500 | 4 | 200 | 440 | 140 | 2.9 | 200 | 1800 | 48 | 110 | 140 | 4 | 14 | 18 |
| 115 | | 70 | 500 | 4 | 170 | 430 | 300 | 0.0 | 0 | 0 | 192 | 110 | 140 | 6 | 6 | 12 |
| 116 | | 80 | 500 | 4 | 200 | 440 | 140 | 0.0 | 0 | 0 | 192 | 110 | 140 | 4 | 14 | 18 |
| 117 | | 70 | 500 | 4 | 170 | 430 | 300 | 2.3 | 160 | 1200 | 48 | 110 | 140 | 6 | 6 | 12 |
| 118 | | 70 | 500 | 4 | 170 | 430 | 300 | 2.9 | 200 | 1200 | 48 | 110 | 140 | 6 | 6 | 12 |
| 119 | | 80 | 500 | 4 | 200 | 440 | 140 | 2.3 | 160 | 1200 | 48 | 110 | 140 | 4 | 14 | 18 |
| 120 | | 80 | 500 | 12 | 200 | 440 | 140 | 2.9 | 200 | 1200 | 48 | 110 | 140 | 4 | 14 | 18 |
| 121 | | 60 | 480 | 12 | 300 | 430 | 280 | 2.9 | 200 | 80 | 48 | 110 | 140 | 4 | 24 | 28 |
| 122 | | 80 | 520 | 4 | 225 | 450 | 100 | 2.9 | 200 | 80 | 48 | 110 | 140 | 4 | 14 | 18 |

FIG. 5

| | | T1 Tensile Strength (MPa) | T1 Proof Stress (MPa) | T1 Elongation (%) | T5 Tensile Strength (MPa) | T5 Proof Stress (MPa) | T5 Elongation (%) | SCC Property | Small R Bending | Microstructure Surface Recrystallization Depth | Comprehensive Evaluation |
|---|---|---|---|---|---|---|---|---|---|---|---|
| | | 470MPa or less | 300MPa or less | 15% or more | 480MPa or more | 460MPa or more | 10% or more | 720cyc or more | no crack when bended by 30% or more | 150 μm or less | |
| 1 | Example | 422 ○ | 269 ○ | 18 ○ | 583 ○ | 557 ○ | 12 ○ | 720 ○ | not cracked ○ | 10 ○ | ○ |
| 2 | | 418 ○ | 265 ○ | 18 ○ | 579 ○ | 553 ○ | 12 ○ | 720 ○ | ○ | 10 ○ | ○ |
| 3 | | 416 ○ | 261 ○ | 19 ○ | 586 ○ | 560 ○ | 12 ○ | 720 ○ | ○ | 10 ○ | ○ |
| 4 | | 414 ○ | 260 ○ | 19 ○ | 587 ○ | 561 ○ | 12 ○ | 720 ○ | ○ | 10 ○ | ○ |
| 5 | | 411 ○ | 263 ○ | 19 ○ | 588 ○ | 562 ○ | 12 ○ | 720 ○ | ○ | 10 ○ | ○ |
| 6 | | 432 ○ | 279 ○ | 18 ○ | 593 ○ | 567 ○ | 11 ○ | 720 ○ | ○ | 20 ○ | ○ |
| 7 | | 430 ○ | 277 ○ | 19 ○ | 595 ○ | 568 ○ | 11 ○ | 720 ○ | ○ | 20 ○ | ○ |
| 8 | | 430 ○ | 280 ○ | 19 ○ | 595 ○ | 570 ○ | 12 ○ | 720 ○ | ○ | 20 ○ | ○ |
| 9 | | 431 ○ | 278 ○ | 18 ○ | 596 ○ | 571 ○ | 11 ○ | 720 ○ | ○ | 20 ○ | ○ |
| 10 | | 425 ○ | 275 ○ | 18 ○ | 598 ○ | 569 ○ | 12 ○ | 720 ○ | ○ | 20 ○ | ○ |
| 11 | | 432 ○ | 279 ○ | 18 ○ | 593 ○ | 567 ○ | 11 ○ | 720 ○ | ○ | 20 ○ | ○ |
| 12 | | 442 ○ | 289 ○ | 18 ○ | 603 ○ | 575 ○ | 11 ○ | 720 ○ | ○ | 20 ○ | ○ |
| 13 | | 445 ○ | 290 ○ | 18 ○ | 605 ○ | 578 ○ | 11 ○ | 720 ○ | ○ | 20 ○ | ○ |
| 14 | | 444 ○ | 288 ○ | 18 ○ | 602 ○ | 580 ○ | 11 ○ | 720 ○ | ○ | 20 ○ | ○ |
| 15 | | 442 ○ | 291 ○ | 18 ○ | 604 ○ | 580 ○ | 11 ○ | 720 ○ | ○ | 20 ○ | ○ |
| 16 | | 446 ○ | 292 ○ | 18 ○ | 605 ○ | 580 ○ | 11 ○ | 720 ○ | ○ | 20 ○ | ○ |
| 17 | | 452 ○ | 299 ○ | 18 ○ | 603 ○ | 577 ○ | 11 ○ | 720 ○ | ○ | 20 ○ | ○ |
| 18 | | 450 ○ | 296 ○ | 18 ○ | 600 ○ | 576 ○ | 12 ○ | 720 ○ | ○ | 20 ○ | ○ |
| 19 | | 448 ○ | 284 ○ | 17 ○ | 607 ○ | 581 ○ | 11 ○ | 720 ○ | ○ | 20 ○ | ○ |
| 20 | | 446 ○ | 272 ○ | 18 ○ | 609 ○ | 582 ○ | 11 ○ | 720 ○ | ○ | 20 ○ | ○ |
| 21 | | 421 ○ | 266 ○ | 18 ○ | 608 ○ | 582 ○ | 11 ○ | 720 ○ | ○ | 20 ○ | ○ |
| 22 | | 422 ○ | 267 ○ | 18 ○ | 609 ○ | 584 ○ | 11 ○ | 720 ○ | ○ | 20 ○ | ○ |
| 23 | | 422 ○ | 256 ○ | 18 ○ | 608 ○ | 583 ○ | 11 ○ | 720 ○ | ○ | 20 ○ | ○ |
| 24 | | 412 ○ | 253 ○ | 18 ○ | 606 ○ | 580 ○ | 13 ○ | 720 ○ | ○ | 20 ○ | ○ |
| 25 | | 450 ○ | 295 ○ | 18 ○ | 605 ○ | 581 ○ | 11 ○ | 720 ○ | ○ | 20 ○ | ○ |
| 26 | | 446 ○ | 275 ○ | 18 ○ | 608 ○ | 583 ○ | 12 ○ | 720 ○ | ○ | 20 ○ | ○ |
| 27 | | 402 ○ | 242 ○ | 17 ○ | 604 ○ | 580 ○ | 11 ○ | 720 ○ | ○ | 20 ○ | ○ |
| 28 | | 403 ○ | 239 ○ | 18 ○ | 605 ○ | 583 ○ | 12 ○ | 720 ○ | ○ | 20 ○ | ○ |
| 29 | | 413 ○ | 259 ○ | 18 ○ | 607 ○ | 583 ○ | 11 ○ | 720 ○ | ○ | 20 ○ | ○ |
| 30 | | 445 ○ | 274 ○ | 18 ○ | 600 ○ | 576 ○ | 11 ○ | 720 ○ | ○ | 20 ○ | ○ |
| 31 | | 468 ○ | 294 ○ | 18 ○ | 597 ○ | 571 ○ | 11 ○ | 720 ○ | ○ | 20 ○ | ○ |
| 32 | | 469 ○ | 298 ○ | 18 ○ | 588 ○ | 564 ○ | 12 ○ | 720 ○ | ○ | 20 ○ | ○ |
| 33 | | 440 ○ | 254 ○ | 17 ○ | 533 ○ | 508 ○ | 14 ○ | 720 ○ | ○ | 20 ○ | ○ |
| 34 | | 430 ○ | 242 ○ | 17 ○ | 532 ○ | 502 ○ | 14 ○ | 720 ○ | ○ | 20 ○ | ○ |
| 35 | | 400 ○ | 237 ○ | 17 ○ | 536 ○ | 506 ○ | 13 ○ | 720 ○ | ○ | 20 ○ | ○ |
| 36 | | 398 ○ | 235 ○ | 18 ○ | 534 ○ | 504 ○ | 12 ○ | 720 ○ | ○ | 20 ○ | ○ |
| 37 | | 397 ○ | 232 ○ | 18 ○ | 535 ○ | 506 ○ | 12 ○ | 720 ○ | ○ | 20 ○ | ○ |
| 38 | | 396 ○ | 232 ○ | 17 ○ | 534 ○ | 505 ○ | 13 ○ | 720 ○ | ○ | 20 ○ | ○ |
| 39 | | 371 ○ | 221 ○ | 18 ○ | 535 ○ | 506 ○ | 13 ○ | 720 ○ | ○ | 20 ○ | ○ |
| 40 | | 372 ○ | 222 ○ | 18 ○ | 531 ○ | 501 ○ | 13 ○ | 720 ○ | ○ | 20 ○ | ○ |
| 41 | | 428 ○ | 244 ○ | 17 ○ | 535 ○ | 505 ○ | 14 ○ | 720 ○ | ○ | 20 ○ | ○ |
| 42 | | 402 ○ | 235 ○ | 17 ○ | 534 ○ | 505 ○ | 14 ○ | 720 ○ | ○ | 20 ○ | ○ |
| 43 | | 388 ○ | 225 ○ | 17 ○ | 536 ○ | 507 ○ | 13 ○ | 720 ○ | ○ | 20 ○ | ○ |
| 44 | | 386 ○ | 222 ○ | 18 ○ | 529 ○ | 499 ○ | 12 ○ | 720 ○ | ○ | 20 ○ | ○ |
| 45 | | 404 ○ | 239 ○ | 18 ○ | 528 ○ | 498 ○ | 12 ○ | 720 ○ | ○ | 20 ○ | ○ |
| 46 | | 438 ○ | 246 ○ | 17 ○ | 498 ○ | 468 ○ | 13 ○ | 720 ○ | ○ | 20 ○ | ○ |
| 47 | | 437 ○ | 266 ○ | 18 ○ | 510 ○ | 482 ○ | 13 ○ | 720 ○ | ○ | 20 ○ | ○ |
| 48 | | 438 ○ | 243 ○ | 18 ○ | 524 ○ | 472 ○ | 13 ○ | 720 ○ | ○ | 20 ○ | ○ |

FIG. 6

| | | T1 Tensile Strength (MPa) | T1 Proof Stress (MPa) | T1 Elongation (%) | T5 Tensile Strength (MPa) | T5 Proof Stress (MPa) | T5 Elongation (%) | SCC Property | Small R Bending | Microstructure Surface Recrystallization Depth | Comprehensive Evaluation |
|---|---|---|---|---|---|---|---|---|---|---|---|
| | | 470MPa or less | 300MPa or less | 15% or more | 480MPa or more | 460MPa or more | 10% or more | 720cyc or more | no crack when bended by 30% or more | 150 μm or less | |
| 101 | Comparative Example | 445 ○ | 274 ○ | 17 ○ | 591 ○ | 565 ○ | 12 ○ | 720 ○ | cracked × | 20 ○ | × |
| 102 | | 450 ○ | 288 ○ | 17 ○ | 584 ○ | 560 ○ | 12 ○ | 720 ○ | × | 20 ○ | × |
| 103 | | 507 × | 326 × | 18 ○ | 578 ○ | 554 ○ | 11 ○ | 720 ○ | × | 20 ○ | × |
| 104 | | 505 × | 324 × | 17 ○ | 534 ○ | 513 ○ | 11 ○ | 720 ○ | × | 20 ○ | × |
| 105 | | 495 × | 304 × | 17 ○ | 507 ○ | 483 ○ | 11 ○ | 720 ○ | × | 20 ○ | × |
| 106 | | 517 × | 363 × | 17 ○ | 598 ○ | 570 ○ | 11 ○ | 720 ○ | × | 20 ○ | × |
| 107 | | 527 × | 373 × | 17 ○ | 573 ○ | 549 ○ | 11 ○ | 720 ○ | × | 20 ○ | × |
| 108 | | 369 ○ | 221 ○ | 17 ○ | 516 ○ | 486 ○ | 13 ○ | 720 ○ | × | 30 ○ | × |
| 109 | | 430 ○ | 242 ○ | 17 ○ | 479 × | 449 × | 13 ○ | 720 ○ | × | 30 ○ | × |
| 110 | | 442 ○ | 257 ○ | 17 ○ | 408 × | 378 × | 12 ○ | 720 ○ | × | 30 ○ | × |
| 111 | | 438 ○ | 243 ○ | 17 ○ | 331 × | 301 × | 13 ○ | 720 ○ | × | 30 ○ | × |
| 112 | | 439 ○ | 237 ○ | 17 ○ | 291 × | 261 × | 13 ○ | 720 ○ | × | 30 ○ | × |
| 113 | | 495 × | 311 × | 18 ○ | 478 × | 448 × | 12 ○ | 720 ○ | × | 30 ○ | × |
| 114 | | 498 × | 323 × | 17 ○ | 469 × | 445 × | 13 ○ | 720 ○ | × | 30 ○ | × |
| 115 | | 451 ○ | 301 ○ | 17 ○ | 602 ○ | 576 ○ | 12 ○ | 720 ○ | × | 20 ○ | × |
| 116 | | 443 ○ | 260 ○ | 17 ○ | 534 ○ | 504 ○ | 13 ○ | 720 ○ | × | 30 ○ | × |
| 117 | | 448 ○ | 282 ○ | 18 ○ | 605 ○ | 580 ○ | 11 ○ | 720 ○ | × | 20 ○ | × |
| 118 | | 510 × | 332 × | 18 ○ | 587 ○ | 562 ○ | 11 ○ | 720 ○ | × | 20 ○ | × |
| 119 | | 437 ○ | 235 ○ | 18 ○ | 535 ○ | 506 ○ | 13 ○ | 720 ○ | × | 30 ○ | × |
| 120 | | 485 × | 282 × | 18 ○ | 512 ○ | 482 ○ | 12 ○ | 720 ○ | × | 30 ○ | × |
| 121 | | 475 × | 318 × | 18 ○ | 517 ○ | 446 × | 14 ○ | 240 × | × | 200 × | × |
| 122 | | 300 ○ | 200 ○ | 19 ○ | 465 × | 425 × | 14 ○ | 720 ○ | not cracked ○ | 20 ○ | × |

METHOD FOR PRODUCING ALUMINUM ALLOY EXTRUDED MATERIAL

The entire contents of Japanese Patent Application No. 2019-029930 filed on Feb. 22, 2019 and Japanese Patent Application No. 2020-005108 filed on Jan. 16, 2020 are incorporated herein by reference in their entireties.

BACKGROUND

The present disclosure relates to a method for producing an extruded material using an aluminum alloy, and more particularly, it relates to a method for producing an aluminum alloy extruded material that has not only high strength but also excellent moldability and corrosion resistance.

In the fields of automobiles, various industrial machinery and the like, there is a demand for further reduction in weight and size, and as a method for achieving the demand, production of a structural member from an aluminum alloy member having high strength is under examination.

As high-strength aluminum alloys, Al—Mg—Si-based (6000 series) alloys and Al—Zn—Mg-based (7000 series) alloys are known.

A 6000 series alloy aims to increase the strength by $Mg_2Si$ precipitation hardening, but when the contents of Mg and Si are high, there arises a technical problem that extrudability is greatly deteriorated.

A 7000 series alloy is a natural aging type alloy, and has a characteristic that addition of Zn less affects the extrudability than that of Mg and Si, but has a technical problem in that stress corrosion cracking resistance is easily deteriorated. Besides, such an alloy has a problem in that it is readily cracked in processing such as bending when the strength is increased.

For example, JP-A-2014-145119 discloses a production method in which a 7000 series aluminum alloy extruded material produced by press hardening is subjected to restoration process for heating it at a temperature increasing rate of 0.4° C./sec or more, retaining the resultant in a temperature range of 200 to 550° C. over 0 seconds, and subsequently cooling the resultant at a cooling rate of 0.5° C./sec or more, and thereafter the resultant is subjected to squeezing and an aging treatment.

In the 7000 series aluminum alloy disclosed in this publication, however, amounts of transition elements of Mn, Cr and Zr to be added are large, and adequate stress corrosion cracking resistance cannot be always obtained. Besides, this alloy is poor in extrudability.

BRIEF DESCRIPTION OF THE DRAWINGS

FIG. 1 illustrates compositions of aluminum alloys (Examples) used for evaluations;

FIG. 2 illustrates compositions of aluminum alloys (Comparative Examples) used for evaluations;

FIG. 3 illustrates production conditions for casted billets and extruded materials (Examples) used for evaluations;

FIG. 4 illustrates production conditions for casted billets and extruded materials (Comparative Examples) used for evaluations;

FIG. 5 illustrates results of the evaluations of extruded materials (Examples).

FIG. 6 illustrates results of the evaluations of extruded materials (Comparative Examples).

DESCRIPTION OF EXEMPLARY EMBODIMENTS

The following disclosure provides many different embodiments, or examples, for implementing different features of the provided subject matter. These are, of course, merely examples and are not intended to be limiting.

In accordance with one of some embodiments, a method for producing an aluminum alloy extruded material, comprising:

subjecting, to extrusion processing, a casted billet of an aluminum alloy containing 6.0 to 8.0% by mass of Zn, 1.50 to 3.50% by mass of Mg, 0.20 to 1.50% by mass of Cu, 0.10 to 0.25% by mass of Zr, 0.005 to 0.05% by mass of Ti, 0.3% by mass or less of Mn, 0.25% by mass or less of Sr, contents of Mn, Zr and Sr being 0.10 to 0.50% by mass, with the balance being Al and inevitable impurities to obtain an extruded material;

cooling the extruded material, immediately after the extrusion processing, to 100° C. or less at a cooling rate of 50 to 750° C./min;

subjecting the extruded material to a heat treatment at 110 to 270° C. after the cooling; and subjecting the extruded material to plastic working within a prescribed time after the heat treatment.

As a result, in some embodiments, when an Al—Zn—Mg—Cu-based alloy is air-cooled immediately after extrusion processing, a recrystallization depth in a surface of an extruded material can be suppressed, and hence, good hardenability and high strength can be obtained.

Exemplary embodiments are described below. Note that the following exemplary embodiments do not in any way limit the scope of the content defined by the claims laid out herein. Note also that all of the elements described in the present embodiment should not necessarily be taken as essential elements.

Now, reasons for setting a composition of an aluminum alloy and production conditions for an extruded material will be described below.

Zn Component

Even when a Zn component is added in a comparatively large amount, high strength can be easily obtained with extrudability deterioration suppressed, but when excessively added, stress corrosion cracking resistance is deteriorated. Accordingly, a content of the Zn component is preferably in a range of 6.0 to 8.0%, and it is noted that "%" used means "% by mass".

Mg Component

A Mg component is the most effective component for increasing the strength of an extruded material, but easily deteriorates the extrudability, and hence an extruded material is easily cracked in plastic working such as bending. Therefore, a content of the Mg component is set to a range of 1.50 to 3.50%.

In order to ensure tensile strength after a T5 treatment of 580 MPa or more through an artificial aging treatment described later, the content of the Mg component is set preferably to a range of 2.40 to 3.50%, and in order to ensure tensile strength after the T5 treatment at a level of 600 MPa, the content of the Mg component is suitably set to a range of 3.0 to 3.50%.

Alternatively, when moldability is regarded more significant and the tensile strength after the T5 treatment is suitably set to a level of 480 to 580 MPa through the artificial aging treatment, the content of the Mg component may be set to a range of 1.50 to 3.0%, and preferably a range of 1.50 to 2.80%.

Cu Component

A Cu component can increase the strength by a solid solution effect in a metal structure, but when added in a large amount, the Cu component tends to cause deterioration of extrudability and moldability, and general corrosion resistance is deteriorated. Therefore, a content of the Cu component is set to a range of 0.20 to 1.50%. The content of the Cu component may be set to preferably a range of 0.20 to 1.00, and more preferably a range of 0.20 to 0.60%.

Mn, Cr and Zr Components

Mn, Cr and Zr components are all transition elements, and have an effect of suppressing recrystallization in a surface portion of an extruded material, otherwise easily occurring in extrusion processing, to suppress a depth of a recrystallized layer in the surface portion. When the amounts of these components added are large, however, hardening sensitivity becomes high in cooling (press end hardening) performed immediately after the extrusion processing.

For example, in JP-A-2014-145119 described above, a Cr component is contained at 0.01 to 0.3%, and the Cr component greatly affects the hardening sensitivity. Therefore, when cooling performed immediately after extruding is at a level performed using a fan or the like, it is difficult to obtain adequately high strength by the artificial aging treatment performed thereafter. Accordingly, the content of the Cr component is preferably 0.01% or less.

The Mn component less strongly affects the hardening sensitivity as compared with the Cr component, but the content is preferably 0.3% or less when it is added.

The Zr component is added to suppress the depth of a recrystallized layer, but there is a limit in an amount dissolvable in an aluminum melt, and hence a content of the Zr component is in a range of 0.10 to 0.25%.

Sr and Ti Components

A Sr component can suppress coarsening of a crystal grain in a structure of a casted billet, and as a result, has an effect of suppressing the depth of a recrystallized layer in a surface portion of an extruded material otherwise easily occurring in the extrusion processing. On the other hand, when the amount of the Sr component to be added is large, a coarse crystallized product containing Sr as a nucleus is easily generated. Therefore, when the Sr component is added, the content is preferably suppressed to 0.25% or less, and for attaining both the strength and the suppression of a recrystallized layer, a total amount of [Mn+Zr+Sr] is preferably in a range of 0.10 to 0.50%.

A Ti component is effective for refining a crystal grain in casting a billet, and a content of the Ti component is set to a range of 0.005 to 0.05%.

Other Components

Impurities easily mixed in casting a billet of an aluminum alloy are Fe, Si and the like. A high content of these components leads to deterioration of the strength and deterioration of bending workability, and therefore, contents of Fe and Si are preferably suppressed respectively to 0.2% or less and 0.1% or less.

Production Conditions for Extruded Material

A chemical composition of an aluminum alloy in a melt is adjusted to the aforementioned range, and a cylindrical billet is continuously casted. When a casting rate is set to 50 mm/min or more, an average crystal grain size in the billet structure is 250 μm or less, and thus, an effect of suppressing the depth of a surface recrystallized layer in the extrusion processing can be obtained.

In the present embodiment, a billet of the aluminum alloy as described above is obtained by the extrusion processing, and immediately after the extrusion processing, the billet is air-cooled using a fan at a cooling rate of 50 to 750° C./min, preferably at a cooling rate of 50 to 500° C. to cool the extruded material to a temperature of 100° C. or less close to normal temperature. When the cooling rate is over 750° C./min, a difference in cooling is caused between different portions of the extruded material to easily cause a strain. Besides, a cooling device used for air-cooling unavoidably has a large scale.

Restoration process disclosed in JP-A-2014-145119 is performed for purpose of obtaining again solid solution of an intermetallic compound precipitated in the metal structure, and therefore, it is necessary to heat the extruded material having been cooled to normal temperature up to a solution treatment temperature of about 400° C. In this case, since the temperature of the extruded material is high, a cooling method employed after the heating is significant.

On the contrary, as a characteristic of the present embodiment, after the extruded material is cooled to 100° C. or less, a heat treatment for heating the extruded material to a range of 110 to 270° C., and preferably a range of 120 to 260° C. is performed. The heat treatment of the present embodiment is performed for purpose of reducing residual stress caused in subjecting the billet to plastic working such as extrusion processing. Accordingly, a heating temperature needs to be 110° C. or more.

A heating time is in a range of 30 to 800 seconds. When the heating temperature is low, reduction of the residual stress is difficult to proceed, and hence, the heating time is preferably longer. When the heating time is long, however, the artificial aging proceeds, and therefore the heating time is set to 800 seconds or less. Thus, stickiness is imparted to the extruded material, and the stress corrosion cracking resistance is also improved.

The aluminum alloy of the present embodiment is a natural aging type alloy, and hence is good to subject it to the plastic working such as bending suitably within 168 hours after the heat treatment.

In the present embodiment, the plastic working refers to plastic deformation of the extruded material, such as bending by press molding, bender bending or the like.

The extruded material of the present embodiment attains high strength by performing the artificial aging treatment after the plastic working such as bending. For example, a two-stage artificial aging treatment (T5 treatment) including a first stage performed at 90 to 120° C. for 1 to 8 hours and a second stage performed at 130 to 180° C. for 1 to 16 hours is performed. This treatment aims to generate primary crystal at the first stage and grow the primary crystal at the second stage, and 0.2% proof stress of 460 MPa or more and tensile strength of 480 MPa or more can be obtained.

A time of the artificial aging treatment is preferably in a range of 2 to 24 hours in total of the first stage and the second stage, and as the total time is longer, the productivity is lowered.

In an extruded material produced by the method for producing an aluminum alloy extruded material of the present embodiment, cracks hardly occur, namely, what is called "stickiness" is caused therein, and as a result, the stress corrosion cracking resistance is improved.

Besides, press end hardening may be performed by a cooling method such as air-cooling using a fan, strain or deformation is difficult to occur in the extruded material, and the productivity is thus improved.

EXAMPLES

1. Test Method

Aluminum alloy melts respectively having compositions shown in tables of FIG. 1 and FIG. 2 were prepared to cast cylindrical billets, and the billets were subjected to homogenization treatment (HOMO). A casting rate, and a temperature and a time of the HOMO are shown in tables of FIG. 3 and FIG. 4. The temperature of the HOMO is preferably in a range of 480 to 520° C.

"Billet Crystal Grain Size" shown in the table refers to an average crystal grain size in a structure of the casted billet. The billet crystal grain size is preferably 250 μm or less in terms of an average grain size.

Each billet preheated to "BLT (billet) Temperature" shown in the table was charged in a container of an extruder for performing the extrusion processing. In order to ensure hardenability, the preheating temperature for the billet ("BLT Temperature") is preferably 400° C. or more, and a temperature of an extruded material immediately after the extruding is preferably 500 to 550° C.

Immediately after the extrusion processing, the extruded material was air-cooled using a fan at "Cooling Rate (° C./min)" shown in the table down to at least 100° C. or less. The cooling rage is preferably in a range of 50 to 750° C./min.

Next, the extruded material was heated at "Temperature Increasing Rate (° C./sec)" shown in the table up to "Heating Temperature (° C.)", and this extruded material temperature was kept for "Heating Time (sec)".

Conditions of the heat treatment were set so as not to cause artificial aging to proceed. For example, the heating temperature is preferably in a range of 110 to 270° C., and the heating time is preferably in a range of 30 to 800 seconds. Besides, the temperature increasing rate for the heat treatment is preferably 1.8° C./sec or more.

Next, after the heat treatment, the extruded material was subjected to prescribed plastic working within 168 hours.

As the prescribed plastic working, bending into an arc with a curvature of 500 to 3000 mm was performed on the assumption of a product shape of a bumper reinforcement, a door beam or the like of a vehicle component.

"Bending Start Time (Natural Aging Time)" shown in the table refers to a time (Hour) elapsed from the end of the heat treatment to the start of the bending.

The aluminum alloys of the Examples are natural aging type alloys, and hence cracks tend to occur when 168 hours or more have elapsed.

Thereafter, the two-stage artificial aging treatment was performed under "Heat Treatment Conditions" shown in the table. "First Stage" of "Heat Treatment Condition (° C.)" shown in the table refers to a heat treatment temperature at the first stage, and "Second Stage" refers to a heat treatment temperature at the second stage. Besides, "First Stage" of "Heat Treatment Condition (hr)" shown in the table refers to a heat treatment time at the first stage, "Second Stage" refers to a heat treatment time at the second stage, and "Total Time" refers to a total time of these stages.

The first stage is performed suitably at 90 to 120° C. for 1 to 8 hours, and the second stage is performed suitably at 130 to 180° C. for 1 to 16 hours.

2. Evaluation Methods

Mechanical properties such as tensile strength, 0.2% proof stress and elongation were measured by preparing a JIS No. 5 test piece from each extruded material in accordance with JIS-Z2241 and by using a tensile testing machine compliant with JIS specification.

The crystal grain size of the billet and the surface recrystallization depth of the extruded material are measured by subjecting a cross-section of the test piece to mirror finishing, and then to a prescribed etching treatment, and performing image processing through observation using an optical microscope.

A test for the stress corrosion cracking resistance was performed as follows. Under a stress corresponding to 80% of the proof stress, each test piece was subjected to 720 cycles each performed under the following conditions, and a test piece in which no cracks occurred was evaluated to meet a target (good).

One Cycle:

The test piece was immersed in a 3.5% NaCl aqueous solution at 25° C. for 10 minutes, was then allowed to stand for 50 minutes in an air atmosphere at a temperature of 25° C. and a humidity of 40%, and thereafter, was naturally dried.

The stickiness property of each extruded material was evaluated as follows. After the artificial aging treatment, a test piece of 20×150 mm was cut out. The test piece was placed on a test bench at a distance of 7 mm, and a load was applied from above using a punch having a tip radius of 1.5 and an outer diameter of 3 mm, and thus, a displacement-load curve was measured. Here, when elongation of a U-bent tip portion became 30% or more before cracks occurred in the tip portion, the extruded material was evaluated to meet a target of stickiness (good).

3. Evaluation Results and Discussion

Evaluation results are shown in tables of FIG. 5 and FIG. 6.

T1 values shown in the table correspond to tensile strength (MPa), 0.2% proof stress (MPa) and elongation (%) obtained before the artificial aging treatment.

When the T1 values of the tensile strength and the proof stress are too large, a stickiness property described later is deteriorated, and target values are shown in the table.

In order to suppress the T1 values of the tensile strength and the like, the heating time after the extruding is set to 270° C. or less, and the heating time is set to 800 seconds or less.

T5 values correspond to tensile strength (MPa), 0.2% proof stress (MPa) and elongation (%) obtained after the artificial aging treatment. Target values according to the present disclosure are shown in the table.

"SCC Property" shown in the table corresponds to the result of the test for the stress corrosion cracking resistance.

"Small R Bending" test shown in the table is for evaluation of the stickiness property of the extruded material.

In Examples 1 to 48, content ranges of alloy components are set within the prescribed range, and production conditions are also within the prescribed range, all the evaluation items for the extruded materials were satisfied.

On the contrary, in Comparative Examples 101 to 105, the heating temperature in the heat treatment was over 270° C., and hence the target could not be met in the small R bending test.

Besides, in Comparative Examples 106 and 107, the heating time was long and over 800 seconds, and hence the target could not be met in the small R bending test.

In Comparative Examples 109 to 114 and 117 to 120, the conditions for the heat treatment were out of the prescribed range, and hence the target could not be met in the tensile strength and the proof stress.

In Comparative Examples 115 and 116, the heat treatment was not performed, and hence cracks readily occurred in the extruded material in the small R bending test.

In Comparative Example 121, the content of the Cu component was high and the Cr component was also added in the composition of the aluminum alloy, and hence the target could not be met in the SCC property. In Comparative Example 122, the content of the Mg component was low, and hence the strength was inadequate.

What is claimed is:

1. A method for producing an aluminum alloy extruded material, comprising:

subjecting, to extrusion processing, a casted billet of an aluminum alloy containing 6.0 to 8.0% by mass of Zn, 1.50 to 3.50% by mass of Mg, 0.20 to 1.50% by mass of Cu, 0.10 to 0.25% by mass of Zr, 0.005 to 0.05% by mass of Ti, 0.3% by mass or less of Mn, 0.25% by mass or less of Sr, a total content of Mn, Zr and Sr being 0.10 to 0.50% by mass, with the balance being Al and inevitable impurities to obtain an extruded material;

cooling the extruded material, immediately after the extrusion processing, to 100° C. or less at a cooling rate of 50 to 750° C./min;

subjecting the extruded material to a heat treatment at 110 to 270° C. for 30 to 80 seconds after the cooling; and subjecting the extruded material to plastic working within 168 hours after the heat treatment.

2. The method for producing an aluminum alloy extruded material according to claim 1, wherein the casted billet has an average crystal grain size of 250 μm or less.

3. The method for producing an aluminum alloy extruded material according to claim 1, wherein the plastic working is bending, and the extruded material is subjected to an artificial aging treatment after the bending.

4. The method for producing an aluminum alloy extruded material according to claim 3, wherein the extruded material after the artificial aging treatment has a tensile strength of 480 MPa or more and a proof stress of 460 MPa or more.

* * * * *